US011274825B2

(12) United States Patent
Lisowski et al.

(10) Patent No.: US 11,274,825 B2
(45) Date of Patent: Mar. 15, 2022

(54) PASSIVE AND NO-LOSS WEATHER CAP FOR PROTECTION OF WIND INDUCED DOWNDRAFT IN SENSITIVE EXHAUST SYSTEMS

(71) Applicants: Darius D. Lisowski, Chicago, IL (US); Dennis J. Kilsdonk, Joliet, IL (US)

(72) Inventors: Darius D. Lisowski, Chicago, IL (US); Dennis J. Kilsdonk, Joliet, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 0 days.

(21) Appl. No.: 15/209,267

(22) Filed: Jul. 13, 2016

(65) Prior Publication Data

US 2018/0017251 A1 Jan. 18, 2018

(51) Int. Cl.

| | |
|---|---|
| ***F23J 13/02*** | (2006.01) |
| ***F23J 13/06*** | (2006.01) |
| ***F23M 9/00*** | (2006.01) |
| ***F23L 17/02*** | (2006.01) |

(52) U.S. Cl.

CPC ..... *F23J 13/025* (2013.01); *F23J 13/06* (2013.01); *F23L 17/02* (2013.01); *F23M 9/006* (2013.01); *F23J 2213/50* (2013.01)

(58) Field of Classification Search

CPC ..... F23J 13/025; F23J 13/06; F23J 2213/50; F23J 11/00; F23L 17/02; F23L 13/00; F23L 11/00; F23L 13/02; F23L 17/12; F23L 17/00; F23M 9/006; F24F 7/00; F24F 2007/001; F24F 7/007; F24F 7/02; E04H 12/28; E04F 17/02; E04F 17/026

USPC ..... 454/35

See application file for complete search history.

(56) References Cited

U.S. PATENT DOCUMENTS

| | | | | |
|---|---|---|---|---|
| 893,467 A * | 7/1908 | Eisenschmid | F24F 7/02 | 454/362 |
| 1,628,980 A * | 5/1927 | Hope | F23J 11/00 | 110/147 |
| 2,071,409 A * | 2/1937 | Klar | F23M 9/006 | 126/307 A |

(Continued)

FOREIGN PATENT DOCUMENTS

| | | | | |
|---|---|---|---|---|
| GB | 416205 | * | 9/1934 | F23L 17/02 |

*Primary Examiner* — Edelmira Bosques
*Assistant Examiner* — Ryan L Faulkner
(74) *Attorney, Agent, or Firm* — Cherskov Flaynik & Gurda, LLC

(57) ABSTRACT

The invention provides a device for removing heat from a building, the device having: a first tubular member defining a first cavity; a second tubular member defining a second cavity, whereby said second tubular member resides within the first cavity and is coaxial to the first tubular member; and a double conic body coaxially residing in the first cavity and coaxially positioned with the second tubular member.

Also provided is a method for removing heat from a building, the method having the steps of: directing heat-containing exhaust emanating from a flue, defining a first diameter, to a passageway received by the flue, whereby the passageway defines a longitudinal axis and a periphery circumscribing the axis; forming the directed exhaust into a slipstream, wherein the slipstream generally travels along the longitudinal axis; and routing precipitation entering the passageway to the periphery.

11 Claims, 5 Drawing Sheets

(56) References Cited

U.S. PATENT DOCUMENTS

| | | | | | |
|---|---|---|---|---|---|
| 2,127,100 | A * | 8/1938 | Whitaker | F23L 17/02 | 126/307 A |
| 2,367,454 | A * | 1/1945 | Wiseman | F23L 17/02 | 454/367 |
| 2,439,353 | A * | 4/1948 | Wiseman | F23L 17/02 | 454/37 |
| 2,482,577 | A * | 9/1949 | Dahlstrom | F24F 7/02 | 181/264 |
| 2,529,045 | A * | 11/1950 | Ortgies | B01D 47/06 | 261/112.1 |
| 2,653,674 | A * | 9/1953 | Ortgies | F23J 11/00 | 261/117 |
| 2,841,071 | A * | 7/1958 | Strawsine | F23J 13/025 | 454/37 |
| 4,655,121 | A * | 4/1987 | Ludwig | F23L 17/14 | 454/3 |
| 5,239,947 | A * | 8/1993 | Schimmeyer | F23M 9/006 | 110/163 |
| 2008/0207105 | A1 * | 8/2008 | Huta | F23L 17/02 | 454/4 |

* cited by examiner

PASSIVE AND NO-LOSS WEATHER CAP FOR PROTECTION OF WIND INDUCED DOWNDRAFT IN SENSITIVE EXHAUST SYSTEMS

CONTRACTUAL ORIGIN OF THE INVENTION

The U.S. Government has rights in this invention pursuant to Contract No. DE-AC02-06CH11357 between the U.S. Department of Energy and UChicago Argonne, LLC, representing Argonne National Laboratory.

BACKGROUND OF THE INVENTION

1. Field of the Invention

This invention relates to a device and method for removing heat from enclosures and more specifically, this invention relates to a passive device and method for removing heat from natural convection venues.

2. Background of the Invention

Removal of heat from high heat venues such as power generating stations, industrial process sites, and large commercial structures is essential to maintain the mechanical integrity of systems housed within those structures.

Heat egress is particularly important in solar chimney and nuclear passive safety systems. When their exhaust flow is impeded, it directly impacts their performance and reduces the effectiveness of the systems. As such, these applications rely on natural convection flow to perform their functions instead of power-driven forced air systems, which can fail.

The exhausts of chimney stacks are positioned above roof lines and fully exposed to the atmosphere. This is to ensure that heated gases discharge without disturbing nearby buildings or people. However, a strong wind can induce downdraft or reverse flow phenomena within the chimney stacks, sending heated air down and out of the chimney inlet and into the building. This can cause discomfort for building occupants and also degrade heat removal abilities of performance-based exhaust systems.

State of the art exhaust ductwork caters to two major types of systems: forced (e.g. fan driven outflow), and natural (e.g. buoyant draft). Natural draft exhaust systems have unique requirements. Exhaust outflow conditions (i.e., ambient air surroundings) directly influences system performance. Minor perturbations (light rain, cross winds) impede outgassing while major perturbations can catastrophically degrade the machinations of the equipment generating the exhaust. Typical applications for natural draft systems include home fireplace heating, solar stills, chemistry/educational fume hoods and nuclear decay heat removal systems in Category B safety systems for nuclear reactors.

Solutions exist for downdraft and rain prevention but rely on mechanical movement of a wind shield such as a rotating vane that angles a shield away from the wind. However, mechanical degradation of bearings or other moving systems can propagate and cause failure of underlying systems relying on ventilation.

Solutions also exist for downdraft and rain prevention but require high exhaust velocity and continuous operation to effectively prevent rain entrainment. Other solutions exist to prevent downdraft and rain entrainment but these solutions restrict the outflow exhaust and impede natural circulation flows.

A need exists in the art for a device and method for venting heat from high heat venues. The system and method should be passive in that no human intervention, energy input (e.g. electricity, heat gradients), or moving parts are required. The system and method should also be fully operational in zero wind conditions, low wind conditions, and in high wind (e.g., greater than 15 knots) conditions. The system also should be operational in any precipitation scenario, be it driving rain, heavy snow, freezing rain, etc. The system should also not impede the natural draft of driving systems.

SUMMARY OF INVENTION

An object of the invention is to provide a method and device for facilitating efficient heat removal from industrial process venues that overcomes many of the drawbacks of the prior art.

Another object of the present invention is to provide a system and method for removing heat from buildings. A feature of the system and method is that it is passive, in that no moving parts, energy input, or human intervention is required to operate. An advantage of the system and method is that it remains operational in the event of personnel shortages, energy shortages, and non-continuous exhaust flow situations.

Still another object of the present invention is to provide a system and method for removing exhaust from industrial process venues. A feature of the invention is a chimney having a first egress end and a second egress end. An advantage of the invention is that the chimney enables exhaust egress from multiple exit paths, simultaneously, or individually, even in heavy cross wind- or precipitation-conditions.

Yet another object of the present invention is to provide a method for removing exhaust from buildings. A feature of the invention is that it relegates incoming fluids to a periphery of a chimney while allowing unencumbered egress of exhaust from the chimney. An advantage of the invention is that it reduces backflow resistance from occurring during venting. This low back pressure feature comprises a double conical body which enhances natural convection flow.

Briefly, the invention provides a device for removing heat from a building, the device comprising: a first tubular member defining a first cavity; a second tubular member defining a second cavity, whereby said second tubular member resides within the first cavity and is coaxial to the first tubular member; and a double conic body coaxially residing in the first cavity and coaxially positioned with the second tubular member.

Also provided is a method for removing heat from a building, the method comprising directing heat-containing exhaust emanating from a flue, defining a first diameter, to a passageway received by the flue, whereby the passageway defines a longitudinal axis and a periphery circumscribing the axis; forming the directed exhaust into a slipstream, wherein the slipstream generally travels along the longitudinal axis; and routing precipitation entering the passageway to the periphery.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invention provides a weather cap chimney with a termination resistance coefficient (loss coefficient), K, between about 0.05 and about 0.15, and typically less than approximately 0.1. Typical values for standard conical cone caps range from 0.5 to 1.25. When handling an exhaust stream at a volume of about 60 cubic feet per minute, the invention exhibited back pressures greater than 0 Pa, but less than approximately 0.25 Pa. This low pressure feature allows the chimney to service intermittent systems having low or non-continuous exhaust flow. The invention is also applicable to systems with natural circulation driven performance such as specialized applications in research and health.

The invention can be deployed as an original chimney, or as a retrofit to existing chimneys. The chimney can start functioning from cold start up conditions, up to any exhaust/flue stack temperatures and flow rates found in residential applications (i.e., fire places, electric-, natural gas-, oil-, and coal fired furnaces), power plant operations, high energy input industrial operations, commercial venues, etc.

Figure 1:
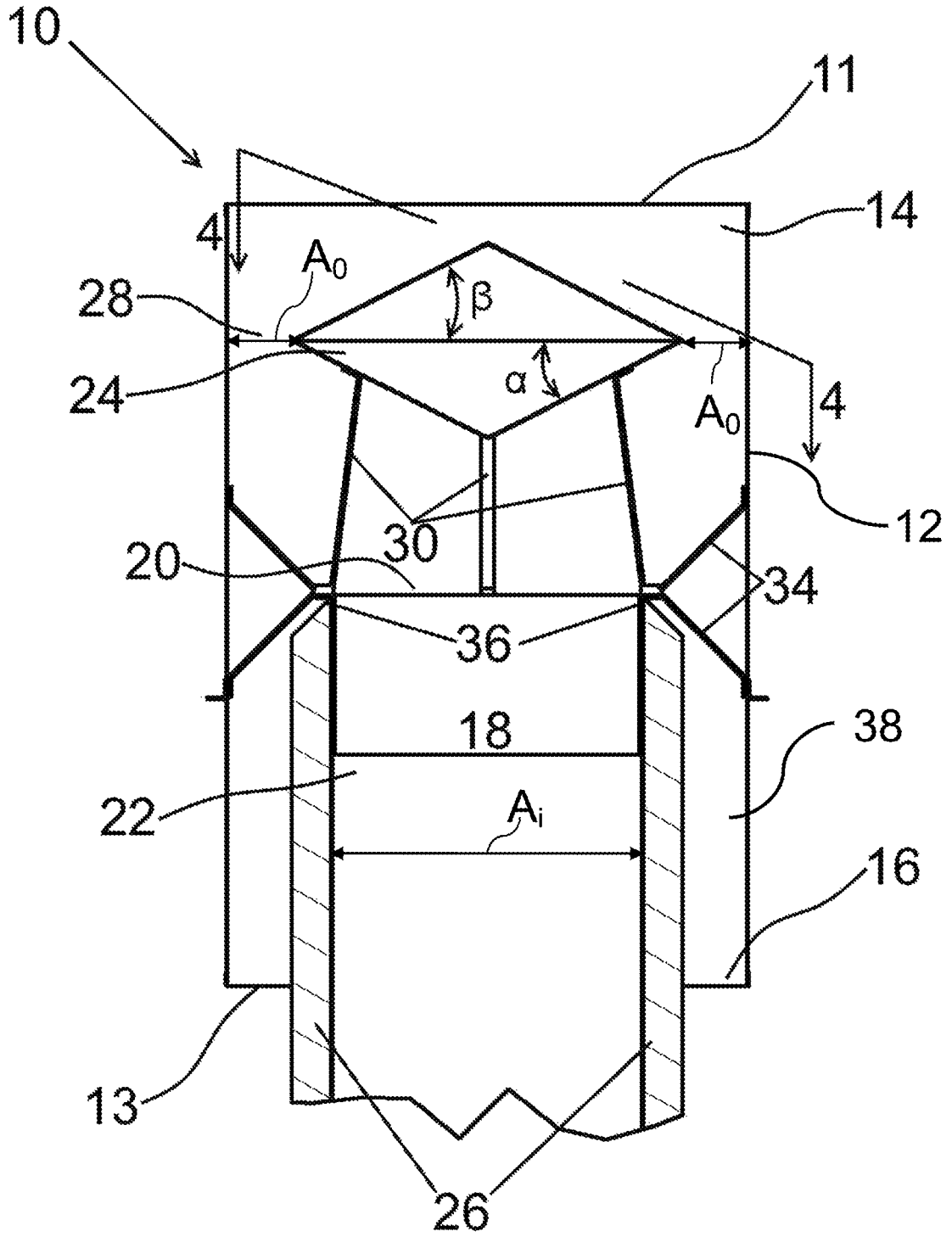
FIG. 1 is an elevational cross sectional view of a chimney cap, in accordance with features of the present invention.

An embodiment of the invented device is depicted as numeral 10 in FIG. 1. It comprises a first tubular member 12 circumscribing a second tubular member 18 such that the longitudinal axes of the two members are coaxial. The first tubular member 12 defines a first superior end 14 and a second depending end 16. Likewise, the second tubular member 18 defines a first superior end 20 and a second depending end 22.

The first tubular member 12 is generally straight and serves as a housing for the device. The first superior end 20 of the second tubular member 18 terminates below the first superior end 14 of the first tubular member 12. The second tubular member 18 is adapted to be slidably received either over, or inside of, an existing building flue 26.

Positioned between the first (superior) end 14 of the first tubular member and the first (superior) end 20 of the second tubular member is a double conic body 24 defining an upwardly facing cone surface and downwardly facing cone surface. As such, the apex of each of the cones point in opposite directions and the bases of each of the cones contact each other. For example, the lower conical cone defining the double conic body provides a smooth leading edge for aerodynamic flow from the exhaust gases in that its apex or point extends toward the flue of the building. The apex of the upwardly facing cone of the double conic body 24 is positioned below the first superior end 14 of the first tubular member 12 so as to be shielded from air currents. The first end of the tubular member extends above the double conic body 24 so as to act as a wind shield.

In an embodiment of the invention, base of the upwardly facing cone is integrally molded with the downwardly facing cone. In other embodiments, the surfaces are detachable from each other such that the resulting double conic body 24 defines surfaces which are symmetrical with each other along an axis or line containing the apices of each cone, or asymmetrical with each other.

The device defines a chimney cap exhaust exit flow area $A_0$, which is a function of: a) chimney duct inner diameter, b) conical cone diameter, c) outer shield inner diameter, and d) any insulation on the outside of the chimney that would change the chimney outer diameter. The ratio of this exit flow area $A_0$ to the cross section of the flow area A; of the existing building flue is between about 1:1 and about 2:1, preferably about 1.5:1, and most preferably about 1.25:1. The annular space 28 defined by the periphery of the conic body 24 and the medially facing surface of the first tubular member 12 has a cumulative horizontal cross section $A_0$ that is greater than the cross section $A_i$ of the inner diameter of the existing building flue 26. In an embodiment of the invented device, $A_0$ equals approximately 1.25 $A_i$ so that the cumulative cross section of the annular space of the device is 25 percent greater than the cross section of the inner diameter of the existing building flue. For example, if the area of the existing flue, $A_i$, (the stack protruding above your roof) is say 10 inch-squared, then the area of our invented chimney cap exit flow area would need to be 12.5 inch-square, or 125 percent greater.

That the conic body 24 has a wider cross section than the second tubular member results in the conic body cantilevering over the periphery of the opening defining the first superior end 20 of the second tubular member. The cantilever configuration of the conic body over the upwardly facing mouth of the second tubular member serves as a deflection means for preventing precipitation (such as rain, hail, snow) and general detritus from entering the second tubular member and therefore the building flue 26.

Figure 2:
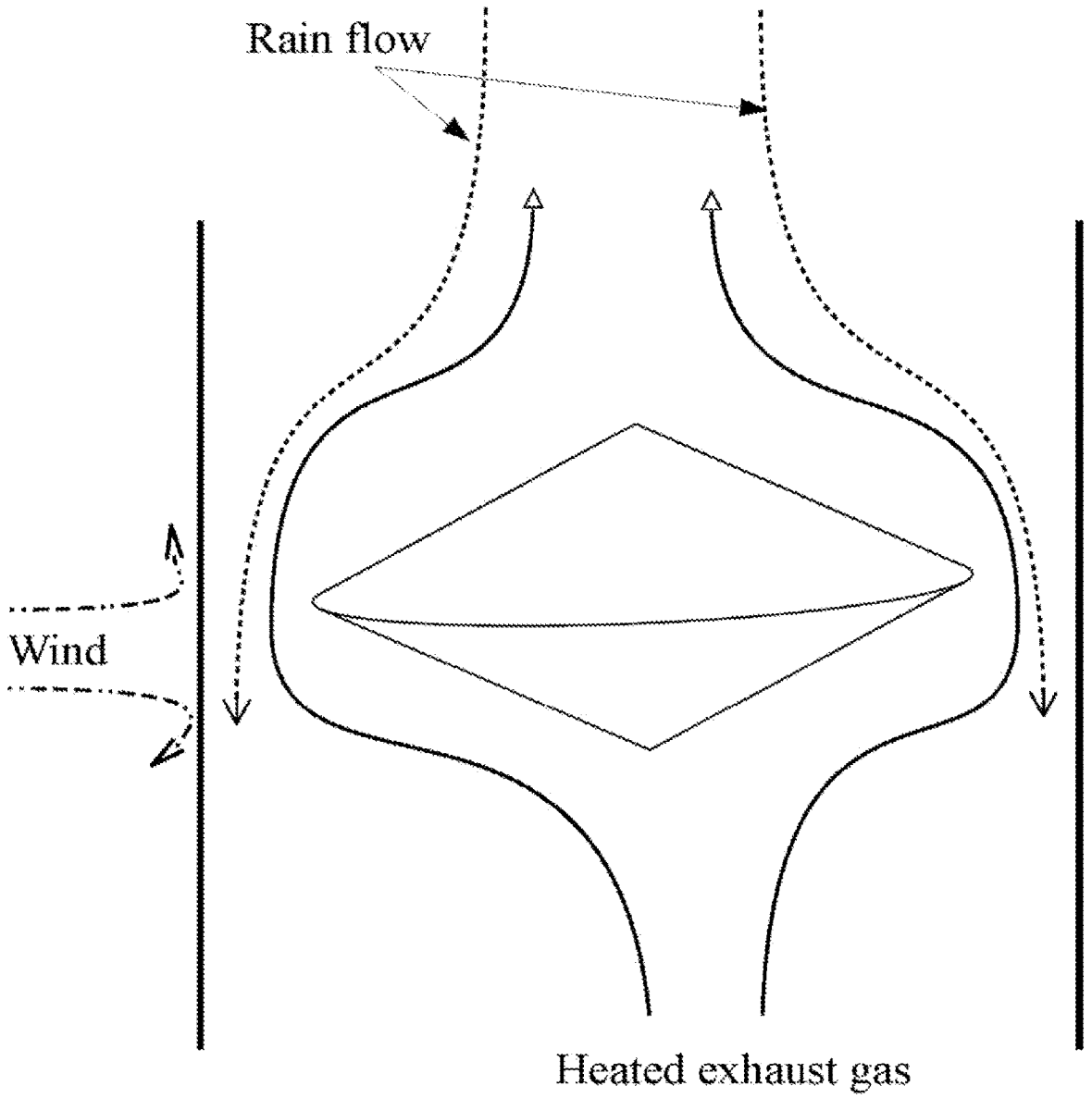
FIG. 2 is a schematic view of a double conic body and fluid flow there around, in accordance with features of the present invention.

FIG. 2 is a detailed elevational view of the double conic body 24. The upwardly extending arrows depict the flow of exhaust, while the downwardly extending arrows depict the flow of any precipitation. The conic shape of the double conic body 24 causes any exhaust, emanating from the second tubular member, to remain in close spatial relationship to the conic body, thereby creating a slip effect, resulting in smooth stream lines. On the lee or downstream side of the slip stream, the exhaust converges to form a column and continues traveling upwardly and out of the device. The exhaust column imposes laterally-directed forces to any precipitation entering from the top of the device. Specifically, this column forces any incoming precipitation to the annular space 28 defined by the periphery of the conic body 24 and medially facing surfaces of the first tubular member 12.

The double conic body 24 is positioned above the first superior end 20 of the second tubular member via a plurality of struts 30. The struts extend upwardly from the first end 20 of the second tubular member 18, each of said struts having a first proximal end attached to the first end 20 and a second end attached to the conic body.

The cross section of the double conical body 24 is larger in diameter than the cross section of the existing building flue. This feature provides a means for preventing rain ingress into the flue. Simultaneous with this water ingress prevention feature, the double conic body presents a surface along which exhaust adheres when exiting the flue. As such, the surface allows exhaust egress from the flue along medial portions of the chimney cross section while simultaneously relegating inflowing precipitation to peripheral regions of the chimney cross section.

Figure 3:
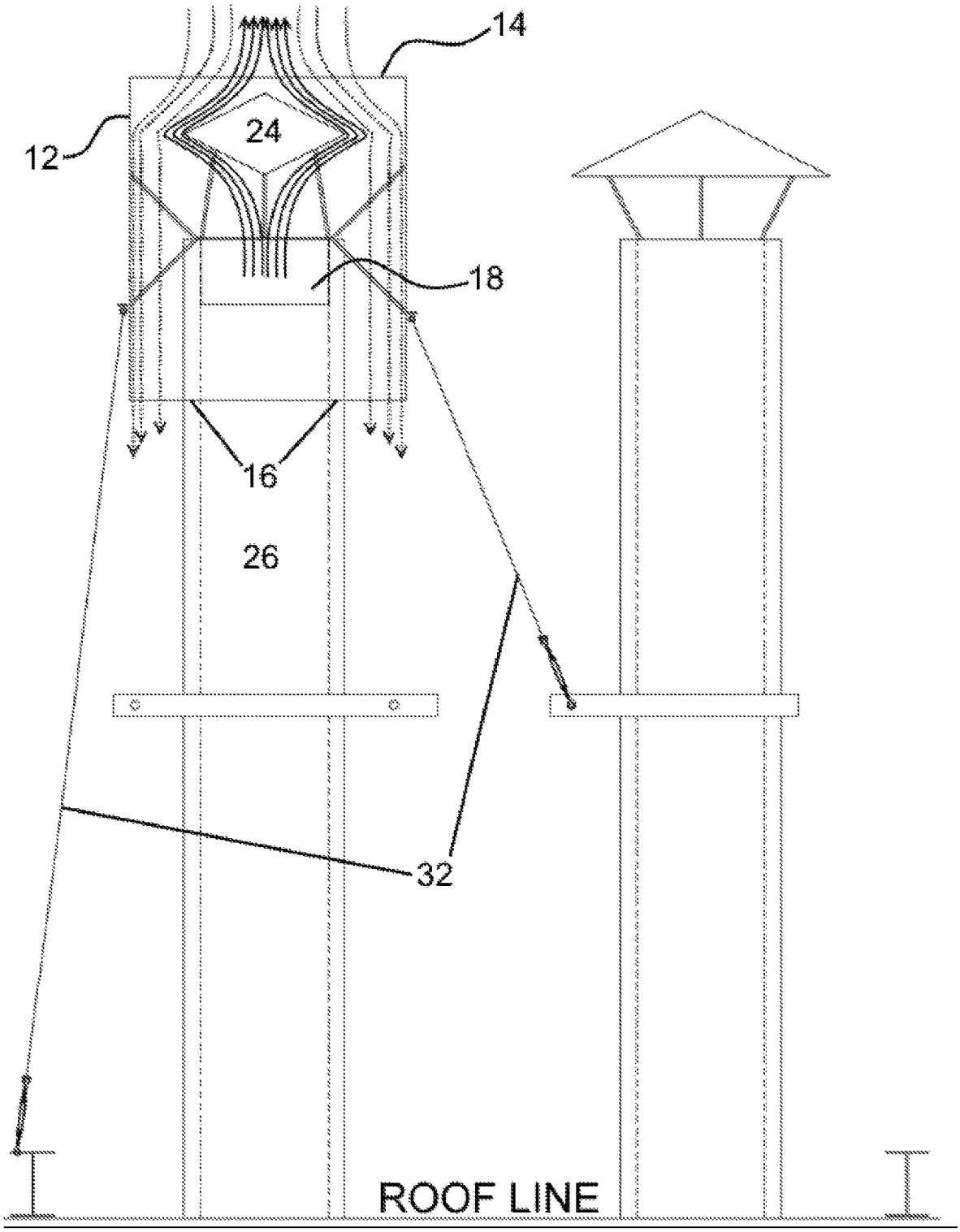
FIG. 3 is an elevational view of a passive chimney cap system juxtaposed to a prior art system, in accordance with features of the present invention.

FIG. 3 depicts the invented system installed on an industrial-type flue. Optionally, for large applications (e.g., chimney diameters about 9 inches or greater) guy wires 32 can be used to stabilize the system to both an existing roof and an adjacent prior art flue stack. For smaller applications (typically residential having chimney diameters of less than about 9 inches), the invented system can be secured with only simple clamps to the existing flue stack outlet.

Once installed, the system allows for two means of exhaust egress, which is from the first tubular member 12 superior end 14 and the first tubular member second depending end 16. Each of these exhaust egress means is an annular space partially defined by a medially facing surface of the first tubular member. The superior positioned exhaust means of egress is further defined by the periphery of the double conic body, that periphery positioned below the rim defined by the superior end of the first tubular member. The inferior positioned exhaust means is further defined by laterally facing surfaces of the second tubular member 18. The laterally facing surfaces of the second tubular member do not protrude below the depending rim (i.e., below the second end 16) of the first tubular member. In embodiments of the invention, the second end 22 of the second tubular member resides above the second end of the first tubular member 12. This configuration results in medially facing surfaces of the first tubular member forming a skirt around the second end of the second tubular body and below the second, depending end of the second tubular body.

Given that the second tubular member is adapted to engage with a distal end of an existing building flue, the aforementioned skirt may also encircle a proximal portion of the building flue not in contact with the second tubular body. As such, in instances where the second tubular member slides over the laterally facing surfaces of the existing building flue 26, laterally facing surfaces of the second tubular member and medially facing surfaces of the first tubular member define a second annular space 38 inferior from the first annular space 28. Alternatively, in instances where the second tubular member slides within the existing building flue 26, then laterally facing surfaces of the existing building flue 26 and medially facing surfaces of the first tubular member define the second annular space 38. This second annular space provides additional egress space for exhaust emanating from the building flue. In such instances, both exhaust and precipitation may be emanating from depending regions of the second annular space 38.

Simultaneous with the system venting exhaust from both its proximal and distal ends (relative to its attachment to the existing flue 26) the second depending end 16 also provides a means of egress for any precipitation or other fluid entering the top of the system.

The embodiment of the system shown in FIGS. 1 and 3 depicts the second tubular 18 member slidably received by distal portions of the existing flue 26 of a building so as to nest within the flue and be encircled by the flue. However, the second tubular member may also be dimensioned to slide over a distal portion of the existing flue. In either case, a cross sectional diameter of the second tubular member is dimensioned accordingly, relative to the cross sectional diameter of the existing building flue 26.

In embodiments where the second tubular member 18 is adapted to slide within an existing building flue, the first superior end 22 of the second tubular member terminates in a laterally extending flange 36. The flange 36 is dimensioned to extend over at least a portion of the periphery of the existing flue 26 so as to aid in supporting the device on the flue. In embodiment where the second tubular member 18 is adapted to slide over an existing building flue, the first superior end 22 of the second tubular member terminates in a medially extending flange (not shown). This medially directed flange has a cross section smaller than the outer diameter of the existing flue to similarly aid in supporting this embodiment on top of the flue 26. Guy wires 32 each having a first end attached to outer surfaces of the device 10 and a second end attached to adjacent structures in the environment (e.g., adjacent chimney stacks, roof decks, buildings etc.) may also be employed to stabilize the device on the flue 26.

In an embodiment of the invention, the topography of the housing of the device (i.e., the exterior surface of the first tubular member 12) defines a continually convex, curved surface. Such convex topography, particularly forming the lateral boundary of the annular space 28 existing between the housing and the double conic body 24, defines a straight fluid passageway. This straight fluid passageway is devoid of any narrowing or medially protruding portions. This feature prevents the development of any back pressure or fluid flow impingement which often occurs when fluid conduit passageways are restricted such as what would occur if portions of the housing topography were concave.

In operation, the device shapes an exhaust plume that is generally coaxial with the device. This causes any exhaust plumes contacting the device to be relegated to the medial portions of the device as depicted by the solid arrowed lines in FIG. 3. This medially positioned plume is the result of the double conic body 24 imposing a slip stream effect on the exhaust exiting the building flue. Other shapes are suitable for imparting the slip effect to the exhaust plume. For example, while the double conic body 24 is symmetrical, other slipstream inducing surfaces may be asymmetrical along their vertical axis. The symmetrical cone is sized to provide sufficient protection against rain ingress and ensure smooth streams from exhaust gases, while balancing physical dimensions. If spatial limitations are not a concern, increasing the conical angle $\alpha$ of the lower cone would improve the exhaust flow and further reduce the added backflow resistance. Similarly, in climates where snow accumulation is unlikely or improbably, the angle $\beta$ of the upper cone could be reduced to decrease the slope. Liquid precipitation would be unaffected and continue to be removed from the system; however snow fall may accumulate and fill the void space.

Generally, the cross section of the upwardly facing surface of any slip-inducing body is greater than the cross section of the distal end of the building flue so as to serve as a precipitation deflector.

Conversely, any precipitation falling into the device will be forced to the periphery of the interior of the device by the medially positioned exhaust plume. The precipitation, depicted in FIG. 3 as dashed arrow lines, will exit the device at its depending end.

As discussed supra, in some situations, exhaust may exit the device from both its first superior end 11 and is second depending end 13. Such scenarios may be observed in either installations with co-located large, irregular objects, or installations where excessive snow fall blocks the first upper end 11 of the device. In situations where large adjacent structures exist, wind patterns are likely to be redirected in a downward vertical direction that would impose wind pressure directly downward onto the cap from above.

Under the second scenario, large snow fall may accumulate on the upper cone, and if not removed either due to elevated temperature from chimney use or mechanical removal, the snow may block the first upper exit. Under both scenarios, exhaust would continue to flow from the second bottom end and the systems functionality would be maintained. In addition, the utilization of the second annular space 38 in these scenarios would eventually cause the entire first tubular member to increase in temperature due to thermal conductance, thereby causing any snow blockage at the first end 11 of the system to melt away.

Figure 4:
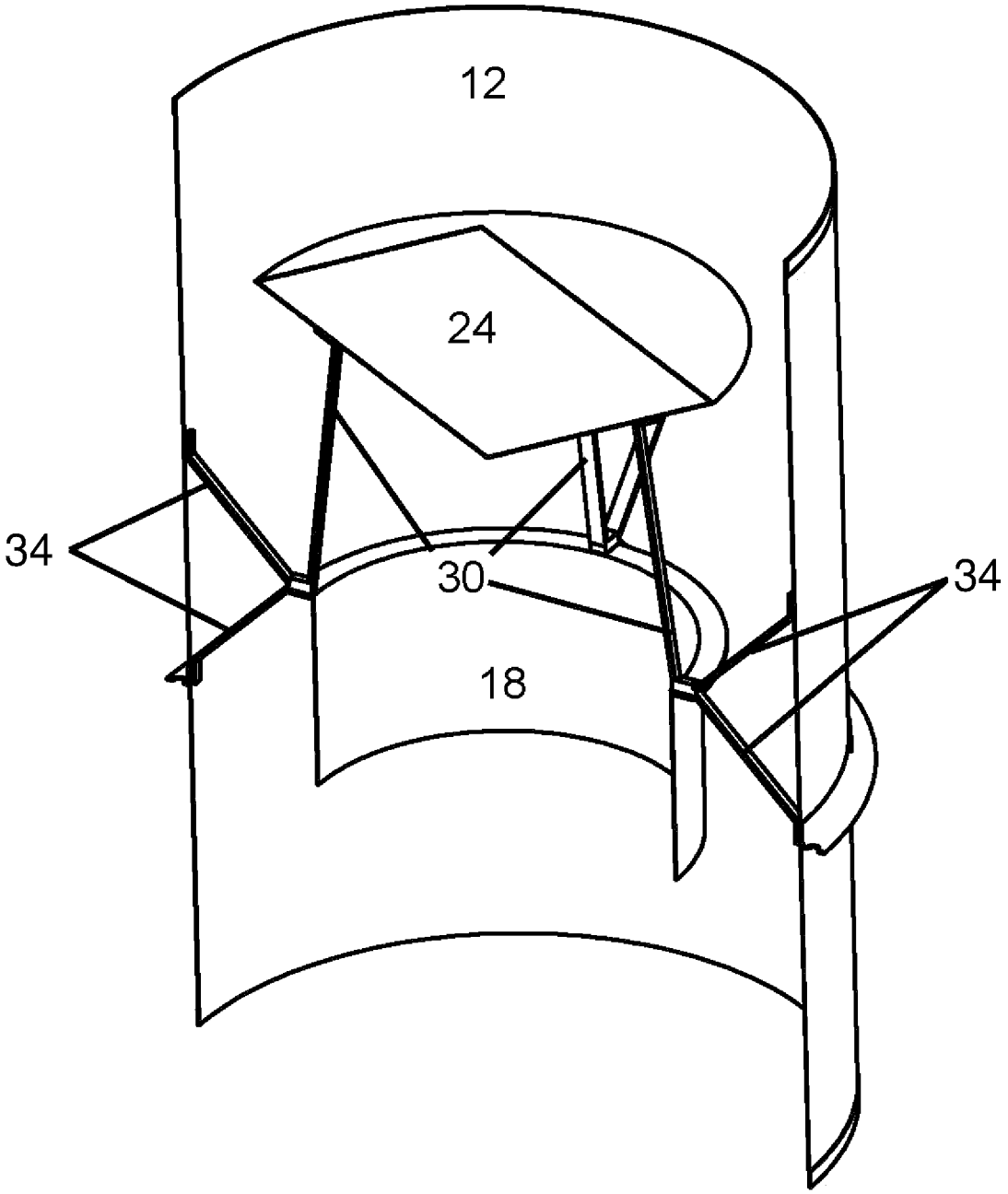
FIG. 4 is a view of FIG. 1 along line 4-4.

A salient feature of the invented device is that it has no movable parts. Its exterior housing (first tubular member 12), its second tubular member 18, and its double conic body 24 are all stationary, relative to each other. The conic body 24 is fastened to the second tubular member 18 by a first plurality 30 of struts. In addition, the second tubular member 18 is fastened to the housing (i.e., the first tubular member 12) via a plurality of radially extending struts 34, as depicted in FIG. 4. FIG. 4 is a view of FIG. 1 along line 4-4. The strut is dimensioned to maintain strength of the entire system and secure the outer tube to the system, while minimally intruding or restricting the flow path area.

In summary, the invention provides a fully passive heat removal system and method. It is applicable for a myriad of heat removal scenarios; for example, it can be easily integrated as part of a reactor cavity cooling system for nuclear and solar power plants. It provides shielding against wind disturbances. It imposes minimal backflow resistance. It protects against rain ingression. It is fully passive in that it embodies no moving parts. It can be an adjunct to already existing chimney stacks.

Figure 5:
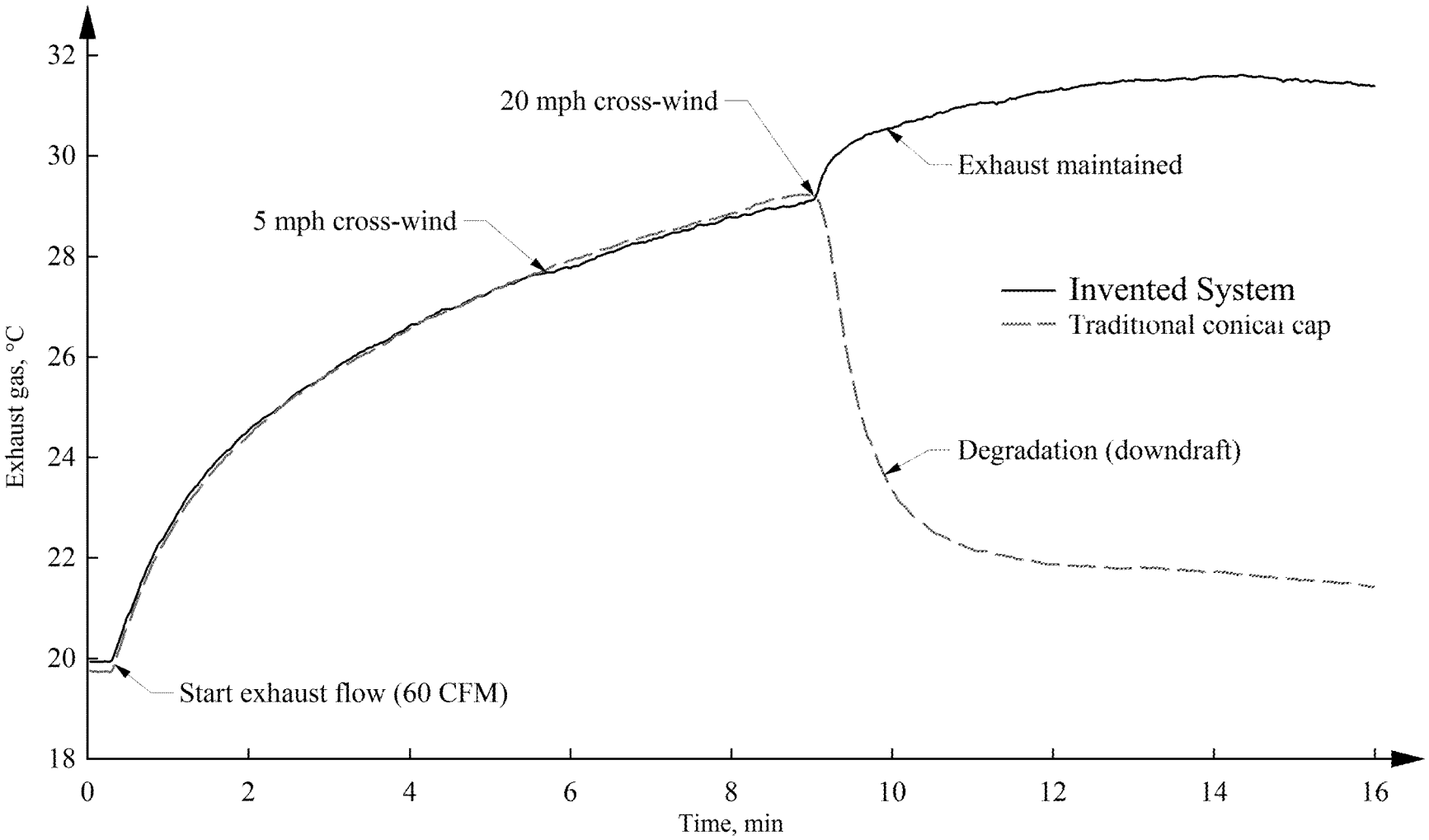
FIG. 5 is a graphical comparison of the efficiency of the slipstream chimney cap compared to state of the art caps, in accordance with features of the present invention.

FIG. 5 is a graph showing performance degradation characteristics of the invented system in a 60 cubic feet per minute exhaust volume. FIG. 5 shows the downdraft phenomena or flow reversals observed when operating a chimney near high wind speeds (e.g., 20 mile per hour cross winds). Without chimney protection (dashed line), the cold wind air is drawn down into the chimney ducts. With the invented caps (solid line), the flue was shielded from the wind and exhaust flow was maintained.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. For example, while the second tubular member 18 as depicted herein has a circular second depending end 22, that depending end can be fitted with a square or rectangular adapter to accommodate existing building flues which are square or rectangular in shape.

Furthermore, while the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The invention claimed is:

1. A method for removing heat from a building through an existing flue, the method comprising: a) directing a heat-containing exhaust emanating from the flue, defining a first inner diameter, to an inner tubular member slidably received by the flue, wherein the inner tubular member has a superior end positioned in a downstream direction from a terminating end of the flue; b) contacting the directed exhaust to a symmetrical, double conic body which is positioned downstream from the superior end of the inner tubular member and upstream of a superior end of an outer tubular member, so as to form the directed exhaust into a slipstream, wherein the slipstream imposes laterally-directed forces to any precipitation entering the superior end of the outer tubular member, a flange dimensioned to extend over at least a portion of the periphery of the existing flue so as to aid in supporting the device on the flue; the flange comprising of at least one strut, wherein the at least one strut comprises of two arms which, respectively, each extend above and below the terminating end of the flue; wherein the outer tubular member is coaxial with and encircles the superior end of the inner tubular member and wherein the outer tubular member is straight and devoid of medially protruding portions downstream of the symmetrical double conic body so as to define a chimney cross section; and c) routing precipitation entering the outer tubular member to a periphery of said outer tubular member.

2. The method as recited in claim 1 wherein the outer tubular member has a depending end, and wherein the precipitation exits an annular space defined by the depending end of the outer tubular member and the flue.

3. The method as recited in claim 2 wherein the annular space is adapted to evacuate or vent, or remove exhaust when the superior end of the outer tubular member is blocked.

4. The method as recited in claim 1 wherein at least a part of the formed exhaust exits through the superior end of the outer tubular member.

5. The method as recited in claim 4 wherein at least another part of the formed exhaust simultaneously exits through a depending end of the outer tubular member.

6. The method as recited in claim 1 wherein the double conic body has a second diameter greater than the first inner diameter.

7. The method as recited in claim 1 wherein a periphery of the double conic body opposes a medially facing surface of the outer tubular member to define an annular space.

8. The method as recited in claim 7 wherein the first inner diameter defines a flow area and the ratio of the flow area to the annular space ranges between 1:1 and about 1:2.

9. The method as recited in claim 1 wherein step c) further comprises relegating the precipitation to peripheral regions of the chimney cross section and exhaust to medial portions of the chimney cross section.

10. The method as recited in claim 1 wherein the symmetric double conic body defines an upwardly facing cone surface and a downwardly facing cone surface, and wherein downwardly facing cone surface is smooth.

11. The method as recited in claim 1 wherein the portion of the outer tubular member downstream from the double conic body is smooth and continuous and devoid of any narrowing portions.

* * * * *